US009441903B2

(12) United States Patent
Brooker et al.

(10) Patent No.: US 9,441,903 B2
(45) Date of Patent: Sep. 13, 2016

(54) PULL THROUGH GUN CLEANING DEVICE WITH ONE OR MORE CYLINDRICAL DOUBLE CONED SHEATHED PRESSURE SECTIONS

(71) Applicant: Otis Products, Inc., Lyons Falls, NY (US)

(72) Inventors: James R. Brooker, Constantia, NY (US); Nicholas Williams, Naples, FL (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 15/013,350

(22) Filed: Feb. 2, 2016

(65) Prior Publication Data

US 2016/0223284 A1 Aug. 4, 2016

Related U.S. Application Data

(60) Provisional application No. 62/111,445, filed on Feb. 3, 2015.

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 29/00; F41A 29/04
USPC ..... 42/95; 15/104.165
See application file for complete search history.

(56) References Cited

U.S. PATENT DOCUMENTS 4,937,907 A 7/1990 Antal
8,943,731 B2 * 2/2015 Niebling ..... F41A 29/02 15/104.05
2014/0123530 A1 5/2014 Williams et al.

OTHER PUBLICATIONS

USPTO International Search Report and Written of the International Searching Authority for International Patent Application No. PCT/US16/16341 mailed Jul. 1, 2016 (13 pages).

* cited by examiner

*Primary Examiner* — Reginald Tillman, Jr.
(74) *Attorney, Agent, or Firm* — Harris Beach PLLC

(57) ABSTRACT

A pull through gun cleaning device includes a plurality of cylindrical double coned pressure sections having a longitudinal tunnel disposed therein. A cable member is threaded through the tunnel of each cylindrical double coned pressure section. A tubular woven sheath is disposed over each cylindrical double coned pressure section disposed along the cable member, and the cable member to form a pull cord. A total length of the pull cord is configured such that where the plurality of cylindrical double coned pressure sections are inserted into one end of a barrel, the pull cord extends past another end of the barrel. Each of the plurality of cylindrical double coned pressure sections provides a radial force pressing the tubular woven sheath of each cylindrical double coned pressure section of the plurality of cylindrical double coned pressure sections against an inside surface or a rifling of the barrel.

18 Claims, 11 Drawing Sheets

PULL THROUGH GUN CLEANING DEVICE WITH ONE OR MORE CYLINDRICAL DOUBLE CONED SHEATHED PRESSURE SECTIONS

CROSS-REFERENCE TO RELATED APPLICATIONS

This application claims priority to and the benefit of U.S. provisional patent application Ser. No. 62/111,445, PULL THROUGH GUN CLEANING DEVICE WITH ONE OR MORE CYLINDRICAL DOUBLE CONED SHEATHED PRESSURE SECTIONS, filed Feb. 3, 2015, which application is incorporated herein by reference in its entirety.

FIELD OF THE APPLICATION

The invention relates to a gun cleaning tool, and particularly to a pull through gun cleaning tool.

BACKGROUND

Barrels of firearms are difficult to clean. Carbon and other residue from gunpowder and from firearm discharge reactions accumulate in firearm barrels, with deleterious effects on cleanliness, performance, and longevity of the firearm. Such residues require partial disassembly of a weapon to access and clean the barrel and associated firing chamber. A number of specialized swabbing, brushing and scraping tools have been introduced to clean firearm components, but have had substantial shortcomings.

SUMMARY

According to one aspect, a pull through gun cleaning device includes a plurality of cylindrical double coned pressure sections having a longitudinal tunnel disposed therein. A cable member is threaded through the tunnel of each cylindrical double coned pressure section of the plurality of cylindrical double coned pressure sections. A tubular woven sheath is disposed over each cylindrical double coned pressure section of the plurality of cylindrical double coned pressure sections disposed along the cable member, and beyond each cylindrical double coned pressure section of the plurality of cylindrical double coned pressure sections the tubular woven sheath disposed over the cable member to form a pull cord. A total length of the pull cord is configured such that where the plurality of cylindrical double coned pressure sections are inserted into one end of a barrel, the pull cord extends past another end of the barrel. An outside diameter of the plurality of cylindrical double coned pressure sections is larger than a bore of the barrel and when compressed by insertion into the bore of the barrel each of the plurality of cylindrical double coned pressure sections provides a radial force pressing the tubular woven sheath of each cylindrical double coned pressure section of the plurality of cylindrical double coned pressure sections against an inside surface or a rifling of the barrel.

In one embodiment, each of the plurality of cylindrical double coned pressure sections includes a thermoplastic.

In another embodiment, each of the plurality of cylindrical double coned pressure sections includes a thermosetting rubber polymer or a thermoplastic elastomer.

In yet another embodiment, each of the plurality of cylindrical double coned pressure sections includes a central substantially cylindrical shape disposed between on either end of the cylindrical shape a substantially cone shaped section.

In yet another embodiment, each of the plurality of cylindrical double coned pressure sections includes a plurality of internal voids.

In yet another embodiment, the cable member includes a coated cable.

In yet another embodiment, the coated cable includes a coating selected from the group consisting of nylon, vinyl, and plastic.

In yet another embodiment, the cable member includes a steel wire.

In yet another embodiment, the tubular woven sheath includes a natural fiber.

In yet another embodiment, the tubular woven sheath includes a synthetic fiber.

In yet another embodiment, the tubular woven sheath includes a fiber selected from the group consisting of a heat resistant material, a meta-aramid, a NOMEX, a para-aramid, a KEVLAR™, a fiberglass, and a K-fiber.

In yet another embodiment, the tubular woven sheath includes a fiber selected from the group consisting of a nylon, a polystyrene, an acetal, an acrylic, a metallic thread, and a brass metallic thread.

In yet another embodiment, the tubular woven sheath includes a phosphorescent thread or a luminescent thread.

In yet another embodiment, the gun cleaning device further includes a fitting disposed at one or both ends of the gun cleaning device.

In yet another embodiment, the gun cleaning device further includes a T-handle mechanically coupled to an end of the cable member by the fitting.

In yet another embodiment, the gun cleaning device further includes an accessory swab attachment mechanically coupled to an end of the cable member by the fitting.

In yet another embodiment, the gun cleaning device further includes an accessory brush attachment mechanically coupled to an end of the cable member by the fitting.

In yet another embodiment, the gun cleaning device further includes an accessory scraper attachment mechanically coupled to an end of the cable member by the fitting The foregoing and other aspects, features, and advantages of the application will become more apparent from the following description and from the claims.

BRIEF DESCRIPTION OF THE DRAWINGS

The features described herein can be better understood with reference to the drawings described below. The drawings are not necessarily to scale, emphasis instead generally being placed upon illustrating the principles of the invention. While the particular embodiments are described in relation to cleaning the interior of a gun barrel, individuals skilled in the art will recognize and understand that the disclosure and embodiments herein are equally applicable to cleaning pipes, conduits and tubing that is both straight and curved. In the drawings, like numerals are used to indicate like parts throughout the various views.

DETAILED DESCRIPTION

A system and tool for cleaning the interior of tubular members is described hereinbelow. In one embodiment, a cleaning device includes a cable member supporting a region of overmolded elastomer around the cable core. The system can also include a tubular woven sheath surrounding at least a portion of the overmolded elastomer. The cable member can include a fitting at one end and preferably at both ends for attachment to any of various auxiliary tools such as swabs, brushes, scrapers, handles, adapters and the like. The system and tools described herein are suitable for the cleaning of the barrels of firearms, such as the barrels of rifles, carbines, pistols.

Other types of pull through gun cleaning devices have been described, such as, for example, in co-pending U.S. patent application Ser. No. 13/785,966, APPARATUS AND METHOD FOR CLEANING THE BARREL OF A FIREARM filed Mar. 5, 2013, and co-pending U.S. patent application Ser. No. 14/076,713 filed Nov. 11, 2013, APPARATUS AND METHOD FOR CLEANING THE BARREL OF A FIREARM, and co-pending U.S. Patent Application Ser. No. 62/111,315, HELICALLY WOUND PULL THROUGH GUN CLEANING DEVICE, filed Feb. 3, 2015, and co-pending U.S. Patent Application Ser. No. 62/111,391, MANDREL BASED HELICAL PULL THROUGH GUN CLEANING DEVICE, filed Feb. 3, 2015, all applications also assigned to the present assignee, Otis Products, Inc. All of the above named applications are incorporated herein by reference in their entirety for all purposes.

Figure 1:
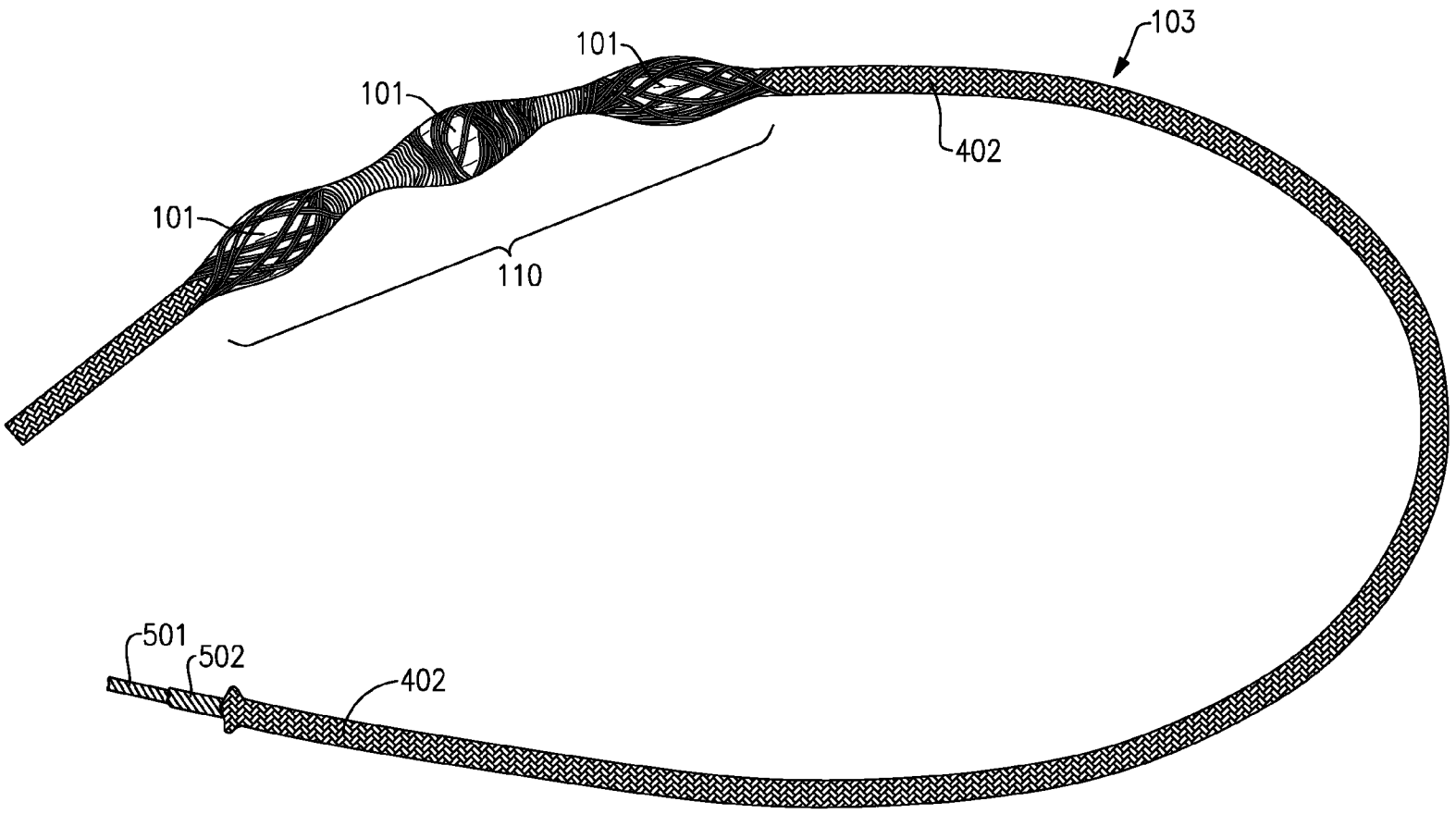
FIG. 1 shows an illustration of an exemplary pull through gun cleaning device with one or more cylindrical double coned sheathed pressure sections.

FIG. 1 shows an illustration of an exemplary pull through gun cleaning device 100 with one or more cylindrical double coned sheathed pressure sections 101. One or more cylindrical double coned sheathed pressure sections 101 are shown in FIG. 1 with a loose woven sheath of a prototype. However, it most embodiments, is contemplated that the sheath will be tight wound around each of the one or more double coned sheathed pressure sections 101 so as to appear closer to the weave 402 over a pull cord 103 of FIG. 1. The pull cord 103 typically is made from a wire rope 501 coated by a coating 502 (typically a plastic or nylon coating) to form a central member or cable member 600 of said pull cord 103. Sheath 402 will be tight woven over both the coating 502 as well as the one or more cylindrical double coned sheathed pressure sections 101. As described in more detail hereinbelow, instead of the open end of FIG. 1 where wire rope 501 is visible, typically there will be a finished end, such as, for example, a fitting, such a threaded fitting to accept a an accessory tool.

Figure 2:
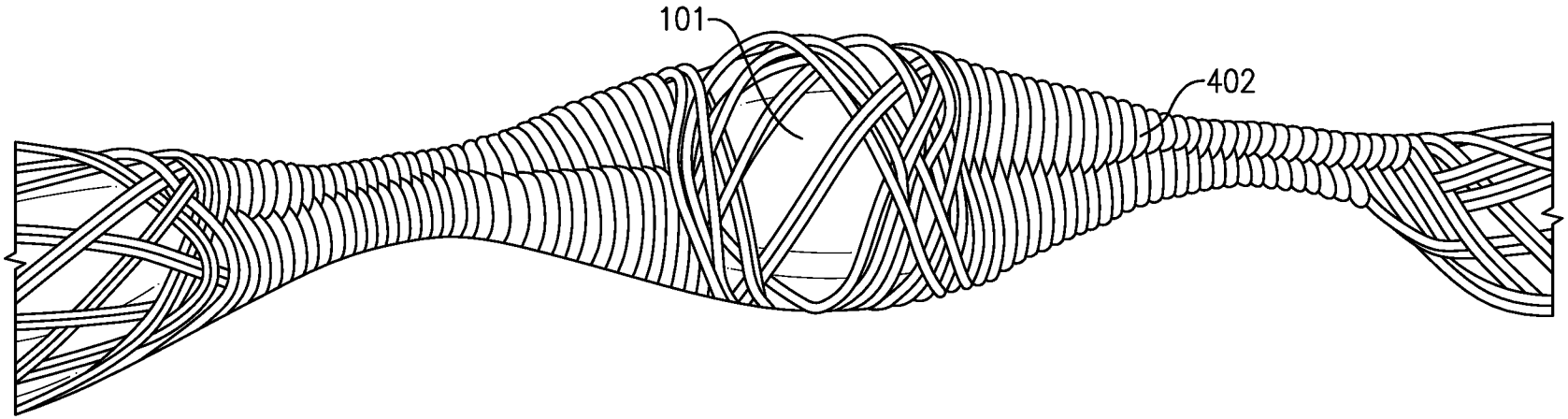
FIG. 2 shows a more detailed view of a double cone pressure section of FIG. 1 with the sheath pulled away.

FIG. 2 shows a more detailed view of a double cone pressure section of FIG. 1 with the sheath pulled away. As described hereinabove, it is contemplated that in most embodiments, the sheath over the one or more cylindrical double coned sheathed pressure sections 101 will have a relatively tight weave similar to the tight weave shown over coating 502 between the cylindrical double coned sheathed pressure sections 101 visible in FIG. 2.

Figure 3:
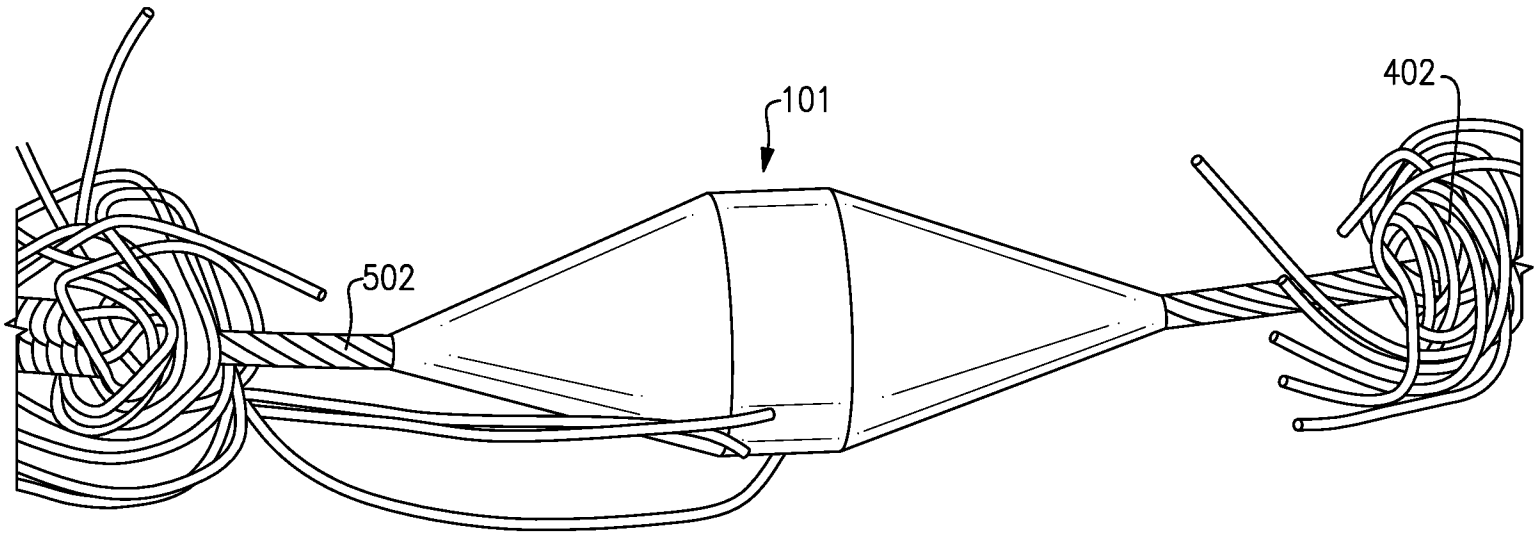
FIG. 3 shows another view of a double cone pressure section of FIG. 2.

FIG. 3 shows another view of a double cone pressure section of FIG. 2 with the sheath 402 completely cut away.

Figure 4:
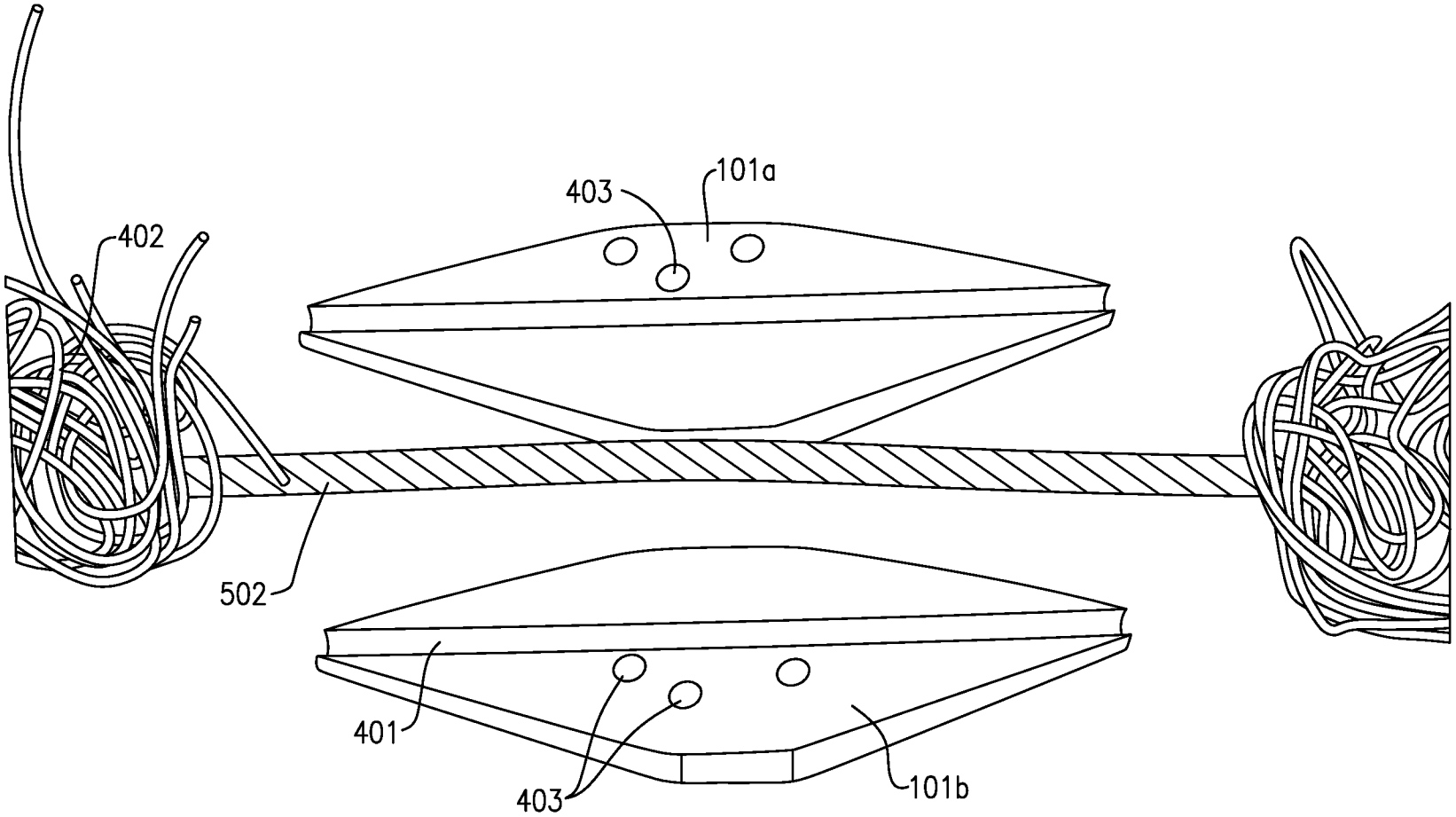
FIG. 4 shows an illustration of the double cone pressure section of FIG. 3 cut in half to show the internal structure.

FIG. 4 shows an illustration of the double cone pressure section of FIG. 3 cut in half to show the internal structure. Typically a cylindrical double coned sheathed pressure section 101 is made, for example, by a molding process as one single part (not made of separate halves). In FIG. 4, the halves 101*a* and 101*b* have been literally and destructively cut from a whole double cone pressure section 101 to show the internal structure. With the cylindrical double coned sheathed pressure section 101 so sectioned, tunnel 401 can be seen which allows the coating 502 part covering wire rope 501 to pass through each cylindrical double coned sheathed pressure section 101. Open bubbles 403 can be an artifact of a thermoplastic molding process, or such bubbles or voids can be intentionally introduced to change the compressibility of a cylindrical double coned sheathed pressure section 101. While one or more about spherical bubbles or voids are generally present, any suitable shaped opening can be used where bubbles, voids, or openings are intentionally placed to set a desired compressibility of a cylindrical double coned sheathed pressure section 101.

Figure 5B:
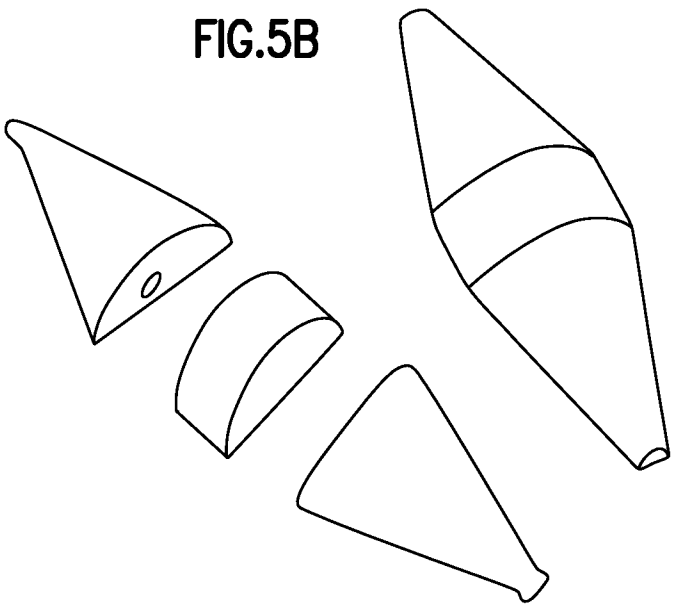
FIG. 5B shows an illustration of another view of the same parts of FIG. 5A.
Figure 5A:
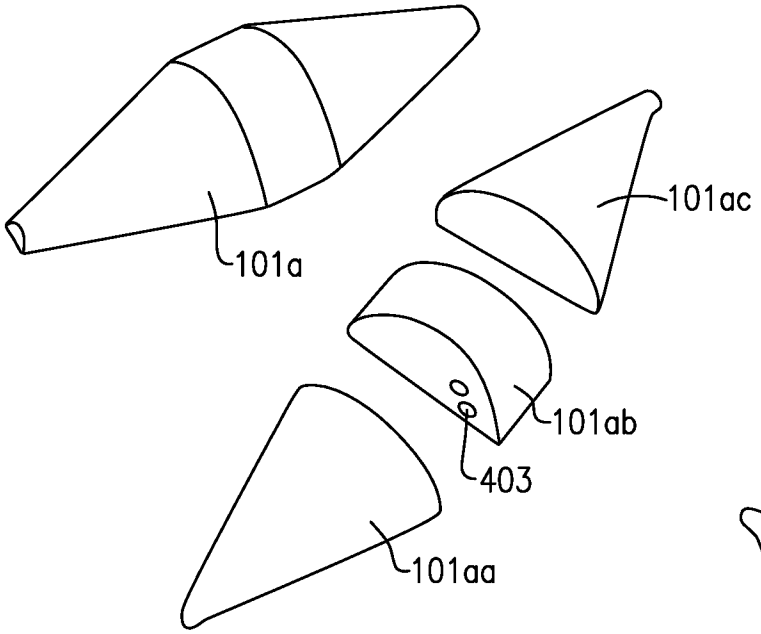
FIG. 5A shows an illustration of a cut half of FIG. 3 further cut into three sections to show half of each of the double cones and the center cylindrical section.

FIG. 5A shows an illustration of a cut half of FIG. 3 further sectioned into three cut parts to show half of each of the double cones and the center cylindrical section. The cut half of a cylindrical double coned pressure section 101*a* has been further destructively sectioned into three parts, illustrating first cone 101*aa*, cylindrical portion 101*ab*, and second cone 101*ac*. FIG. 5B shows an illustration of another view of the same parts of FIG. 5A. As described hereinabove, in most embodiments, each cylindrical double coned pressure section 101 is typically thermoformed or molded as a single part. The halved and triple sectioned illustrations are merely intended to help one skilled in the art better understand the new typically thermoformed structure.

It was realized that such a pull through gun cleaning device with one or more cylindrical double coned sheathed pressure sections provides superior contact of the sheath with the inside surface of either a smooth bore or a rifled bore of a weapon barrel compared to prior art bulbous sections typically having spherical or ball like shapes. One problem with a spherical shaped bulbous section is that it makes only tangential contact over a relatively small surface area with the internal surfaces of the barrel. By contrast, the cylindrical section of the cylindrical double coned pressure section causes a pressure contact with the internal surface of the barrel over a significantly larger surface area (the surface defined by the sheath over the outer surface of the cylindrical section of the cylindrical double coned pressure section.

On the other hand, compared with a simple cylindrical shape, the cones provide a relatively low pull force as they guide the cylindrical section into or out of the barrel. The cones allow the cylindrical section to compress progressively as the sheathed cylindrical double coned pressure section 101 is pulled from either side, into or out of the barrel.

The cylindrical double coned pressure sections can be made from any suitable material, typically a material that offers some compressibility so that once compressed the combination of the compressed sheath and cylindrical double coned sheathed pressure sections provide an outward pressure perpendicular to the center line of the bore so as to force the cleaning sheath against the interior surface of the bore (smooth or rifled) so that the sheath is forced against the interior surface as the sheathed cylindrical double coned pressure sections are pulled through the barrel. For example, cylindrical double coned pressure sections can be formed of a thermosetting rubber polymer, such as by injection molding onto the coating 502 of the central member defined by coating 502 over wire rope 501 of the pull cord 103. Any suitable material, such as for example, any suitable thermoplastic elastomer can be used.

It was also realized that by using a tight substantially continuous weave over both the coating 503 and the cylindrical double coned pressure sections 101 at time of manufacture that in many embodiments, in some embodiments, there is no need for an end user to need to pull on the cleaning sheath. Also, in embodiments where the sheath is tight woven over both the coating 503 and the cylindrical double coned pressure sections 101, there is no need for cross stitching to hold each cylindrical double coned pressure section in place on the coating 502 of the wire rope 501 of pull cord 103.

Figure 12:
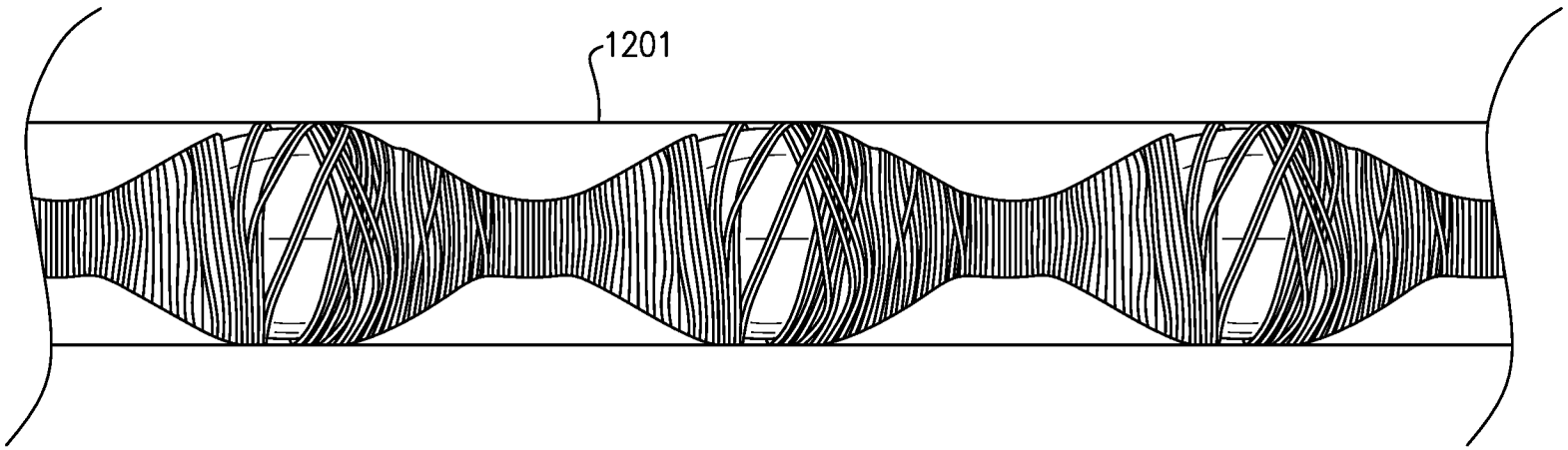
FIG. 12 shows a contemplated view of the exemplary mandrel based pull through gun cleaning tool of FIG. 1 inside a shotgun barrel.

FIG. 12 shows a contemplated view of the exemplary pull through gun cleaning device 100 with one or more cylindrical double coned sheathed pressure sections 101 of FIG. 1 inside a shotgun barrel.

Figure 6A:
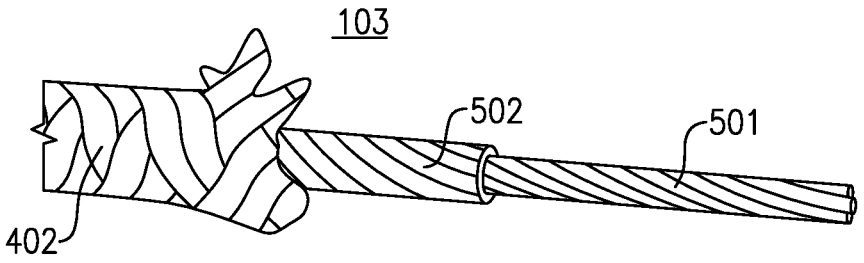
FIG. 6A shows an illustration of an exemplary coated cable pull cord.
Figure 6B:
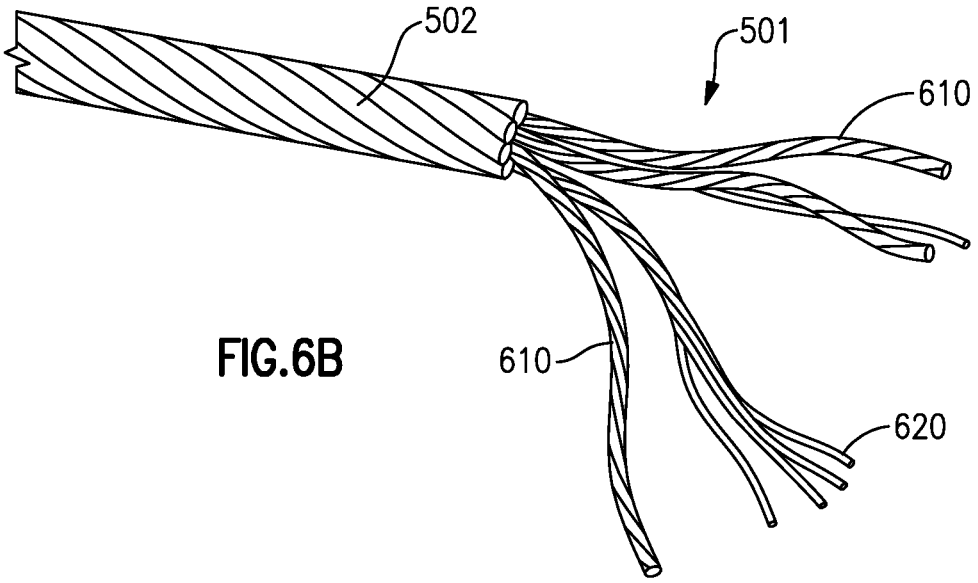
FIG. 6B shows an illustration of the stranding of the wire rope of the coated cable member of FIG. 6A.

FIG. 6A shows an illustration of an exemplary cable member 600 suitable for use as a pull cord 103. Wire rope 501 is typically formed from a plurality of strands or bundles, each bundle having a plurality of wires. The coating 502 can be formed form any suitable material, such as, for example, nylon, vinyl, plastic, or any other suitable material. FIG. 6B shows an illustration of the stranding of the wire rope of the coated cable member of FIG. 6A. The exemplary cable member 600 of FIG. 6B has a coating 502 over 5 bundles of 7 wires each to form wire rope 501. Typically the wires are made from steel, such as, for example, stainless steel, galvanized steel, or zinc coated steel. The cable member 600 can be, for example, a pre-assembled coated aircraft cable wire, or any other suitable commercially available pre-assembled coated cable wire which is well-known in the art.

EXAMPLE

The following prototype pull through gun cleaning device with one or more cylindrical double coned sheathed pressure sections was manufactured. The exemplary tool was about 30" long. The pull cord, or long straight section was about 0.15" in diameter including the tubular woven sheath over the coated cable. The exemplary cylindrical double coned pressure section had an outside diameter of the central cylindrical section of about 0.67". The width of the central cylindrical section is about 0.3". The length of each of the two conic sections on either side of the central cylindrical section is about 0.8"

While the exemplary embodiments described hereinabove are based on a coated wire cable, the cable member can comprise any suitable material or elongate form, e.g., fiber rope or cord, rod, wire, or twisted or braided cable and can be rigid, semi-rigid or semi-flexible. The rigid or semi-rigid structure of a pull through gun cleaning device with one or more cylindrical double coned sheathed pressure sections makes it an excellent gun barrel obstruction remover. In some embodiments, the cable member can have sufficient rigidity to be easily threaded or passed through the tubular member. A wire cable as described hereinabove can also be formed of a metal such as galvanized steel, preferably formed to have a natural curl for ease of laterally coiling in storage and preferably having a protective plastic coating. The protective plastic coating reduces the risk of scratching gun components and the potential for fraying of the cable. With respect to the cleaning of tubular members other than gun barrels, a semi-rigid structure of the core can accommodate some slight or eventual curves in the interior of a pipe, conduit or tube. However, a semi-flexible pull cord is preferable for cleaning sections of pipe, conduit or tubes having substantially curved shapes and turns between straight segments of tubular members.

Figure 7:
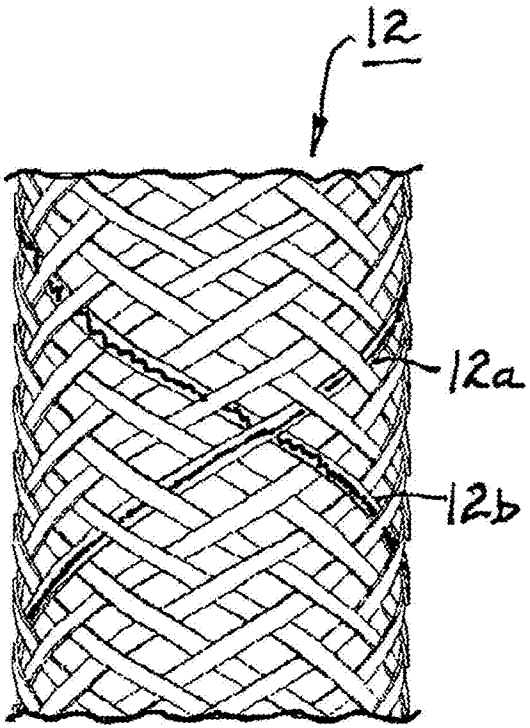
FIG. 7 is an elevational view of a portion of a tubular woven sheath in accordance with the present invention.

FIG. 7 shows an exemplary tubular woven sheath. Sheath 12 can be woven of primarily a natural fiber such as cotton, although synthetic fiber can be included; and 100% synthetic fiber is fully comprehended by the invention. Many natural fibers are sufficiently absorbent to retain adequate amounts of cleaning solvent without the need for sections of additional absorbent sponges between the sheath and the core. Additional special-purpose threads, such as fiber-optic 12*a*, phosphorescent or luminescent threads 12*b*, can also be woven into the sheath to provide, for example, auxiliary lighting for visual inspection of a gun barrel for cleanliness as tool 10 is withdrawn. In another aspect of the invention, the woven sheath can comprise fibers of heat resistant materials, such as meta-aramids, NOMEX, para-aramids, KEVLAR, fiberglass, K-fiber, or the like. In another aspect of the invention, synthetic fibers, such as nylon, polystyrene, acetals, acrylics or the like, or metallic thread, such as brass or the like, can be incorporated into the sheath to increase the abrasive characteristic of the sheath to assist in removal stubborn residue from the barrel. Sheath 12 can be woven, for example, on a tubular commercially available braiding machine Where the sheath is comprised of heat resistant fibers or materials, cleaning of the sheath can also be performed by the application of sufficient heat to burn off the accumulated residue. For example, the tool 10 or the sheath 12 could be placed in an oven at a temperature below the melting or deformation temperature of the fibers such that any dirt or carbon residue detaches from the fibers of the sheath.

Figure 8:
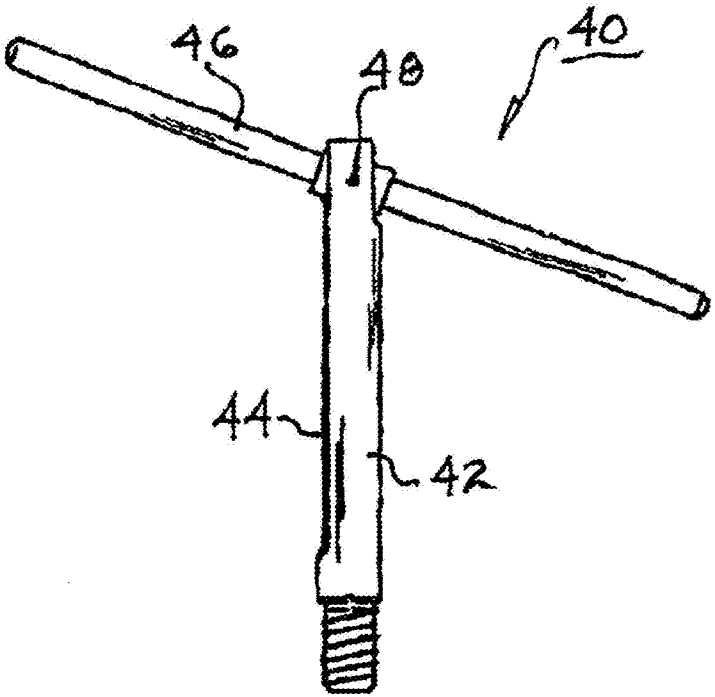
FIG. 8 is an elevational view of a foldable T-handle.

FIG. 8 is an elevational view of a foldable T-handle, also referred to interchangeably herein as a "pull-through handle tool", formed for passage in folded configuration through the barrel of a weapon. Referring to FIG. 8, an exemplary foldable T-handle 40, comprising a threaded shaft 42 having a longitudinal well 44 and a pivotable handle 46 attached to shaft 42 by pin 48 formed for passage in folded configuration through the bore of a weapon, is attachable to either of fittings 28, either before or after passage through a gun barrel of a leading end of apparatus 10, to assist a user in pulling apparatus 10 through a gun barrel. Where embodiments of the invention are used to clean the interior of tubular members having curved shapes, the T-handle is preferably attached to the fitting at the leading end of the cable member after it is threaded through the tubular member. Where the interior of the tubular member is straight, a slim profile T-handle can be attached to the fitting at the leading end of the pull cord, or can be integrated with the fitting at the leading end of the pull cord. An exemplary slim profile T-handle is disclosed in U.S. patent application Ser. No. 13/448,973 entitled "Firearm Pull-Through Cleaning Tool with Integrated Foldable Handle," filed on Apr. 17, 2012 assigned to the common assignee of this application, which is hereby incorporated by reference in its entirety.

Figure 9:
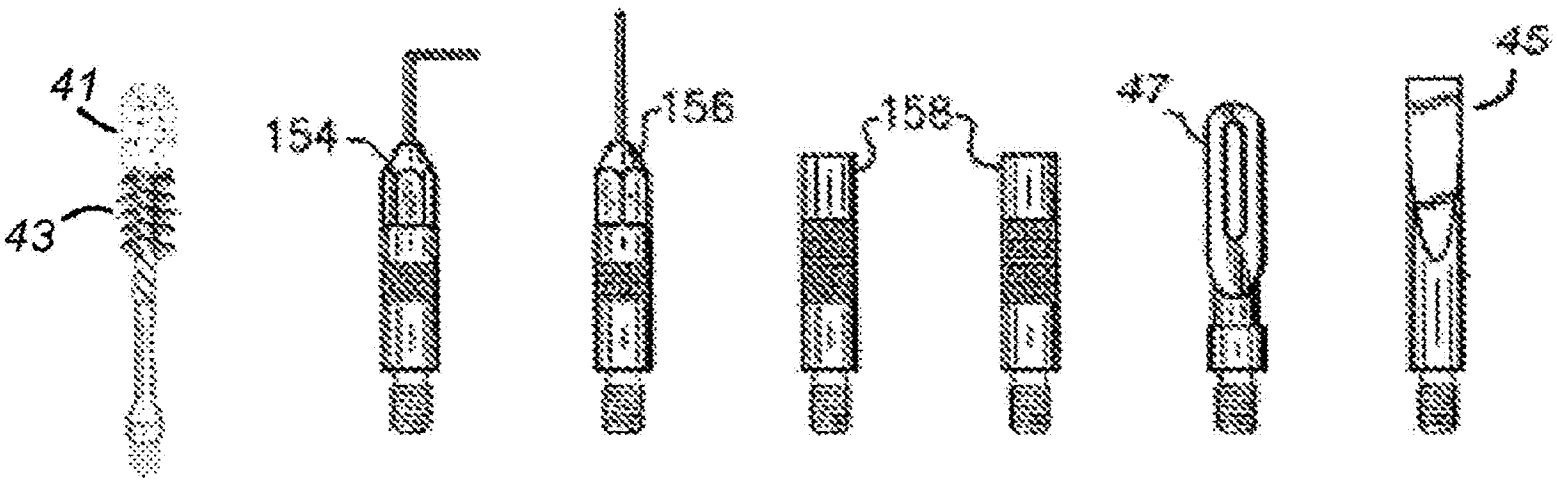
FIG. 9 depicts an assortment of typical auxiliary tools adapted to attach to the fittings at the end of the pull cord.
Figure 10A:
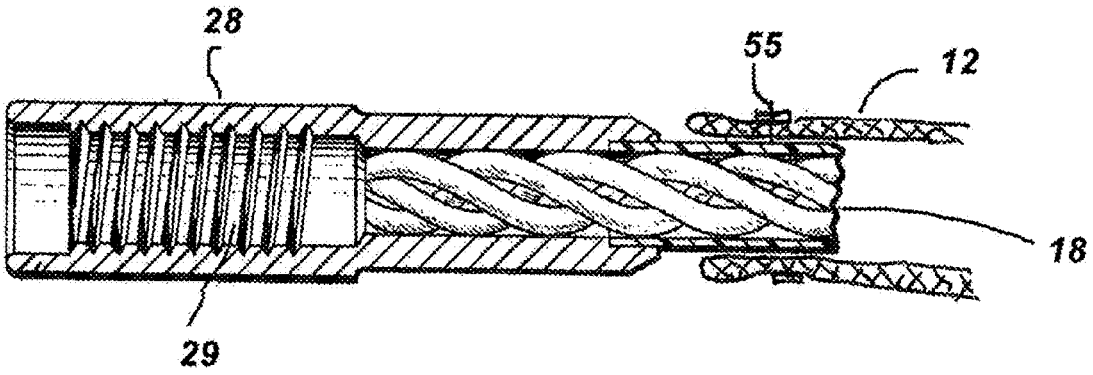
FIG. 10A depicts a crimping ring retaining the tubular woven sheath on the pull cord.
Figure 10B:
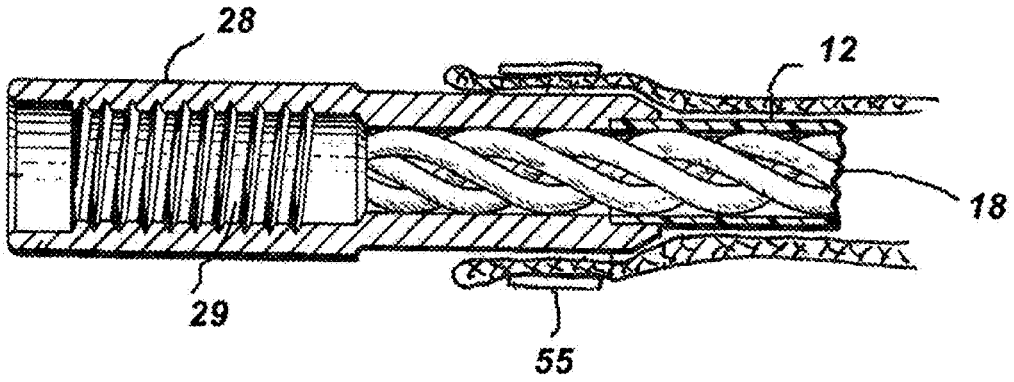
FIG. 10B depicts another embodiment wherein the crimping ring retains the sheath against a fitting at the end of the pull cord.

With reference to FIG. 9, FIG. 10A and FIG. 10B, cable member 18 preferably includes a fitting 28 at one end, and preferably at both ends, for attachment to any of various auxiliary tools such as swabs 41, brushes 43, scrapers 45, tips 47, a T-handle 51, and the like, as well as a cable extender and/or serially connection additional gun barrel cleaning tools 10. The fittings can be crimped, bonded or cold welded to the end of the pull cord. The fittings 28 can have internal or external threads 29 or other quick connect mechanisms to couple with the fittings of the auxiliary tools as depicted in FIG. 9.

Figure 11:
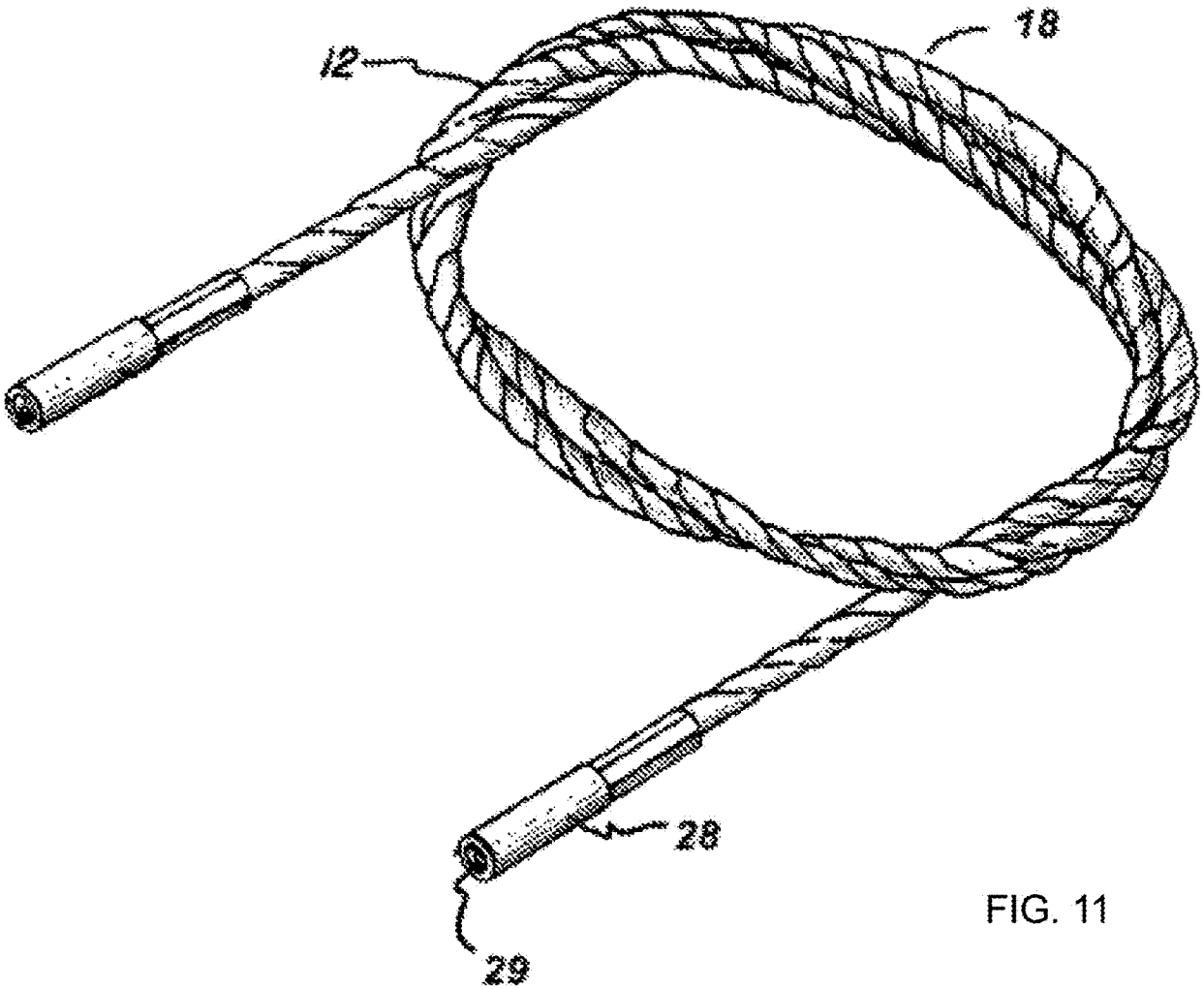
FIG. 11 depicts an embodiment of a cable member having fittings on the leading and trailing ends thereof in a coiled position.

FIG. 11 depicts an embodiment of a cable member having fittings on the leading and trailing ends thereof in a coiled position. While not showing a pull through gun cleaning device with one or more cylindrical double coned sheathed pressure sections, FIG. 11 shows how fitting can be affixed to either or both ends of a pull through gun cleaning device with one or more cylindrical double coned sheathed pressure sections. In some embodiments, the fittings 28 can also be sized and configured to attach one or both of the leading or trailing end of the sheath to the pull cord. Alternatively, as depicted in FIG. 10A and FIG. 10B, a separate crimping ring 55 or other suitable connector can be utilized over the sheath 12 and the cable member 18 or the fitting 28 to retain the edge of the sheath in place over the pull cord 18 including the sheath 12. In some embodiments, it may be sufficient to crimp over the central core alone.

In some embodiments, the sheath 12 is not connected to the fittings or cable member 18, but held in place by the tight fit of the woven sheath 12 over any protrusions or the double coned sheathed pressure sections. In some embodiments, the sheath can be removable from the tool for cleaning to remove build-up of removed residue. The sheath 12 can include elasticized threads to assist in the removal, cleaning and/or replacement of the sheath. Alternatively, cleaning can be accomplished by soaking the coiled tool in a suitable detergent solution and rinsed to remove the accumulated build-up of dislodged residue.

The respective thicknesses of the central core of the pull cord, protective layer, any over-molded protrusions, absorbent materials and the woven sheath can be varied to change the radial width of the tool to fit the gun barrels of differing calibers. Alternatively, the compressibility of any over-molded protrusions, or the double coned sheathed pressure sections, absorbent material and/or the woven sheath can also be increased so that a single tool can appropriately clean a range of calibers of gun barrels.

In some embodiments, the natural fibers of the sheath and any absorbent material disposed beneath the sheath or at the trailing end of the cable member can be used to absorb and remove spent cleaning fluids containing dislodged residue. However, the overmolded thermoplastic region has been successfully deployed to clean a variety of relatively narrow tubular members without a sheath. A plurality of cylindrical double coned sheathed pressure sections, or the double coned sheathed pressure sections, is effective at removing liquids and semi-solids such as grease and congealed oils, from narrow drains. A plurality of cylindrical double coned sheathed pressure sections and any additional protrusions, ridges, or other physical features covered by a sheath can wipe excess accumulations of liquids and semi-solids in the manner of a squeegee from the interior of a pipe or drain. Even where a pipe or drain includes a catch or other curved portion, embodiments of the invention utilizing a semi-flexible cable member were threaded through the drain and pulled through the tubular member. This embodiment removed excess accumulations of grease and spent oils in a small fraction of the time of other common methods.

It will be appreciated that variants of the above-disclosed and other features and functions, or alternatives thereof, can be combined into many other different systems or applications. Various presently unforeseen or unanticipated alternatives, modifications, variations, or improvements therein can be subsequently made by those skilled in the art which are also intended to be encompassed by the following claims.

What is claimed is:

1. A pull through gun cleaning device comprising:

a plurality of cylindrical double coned pressure sections having a longitudinal tunnel disposed therein;

a cable member threaded through said tunnel of each cylindrical double coned pressure section of said plurality of cylindrical double coned pressure sections;

a tubular woven sheath disposed over each cylindrical double coned pressure section of said plurality of cylindrical double coned pressure sections disposed along said cable member, and beyond each cylindrical double coned pressure section of said plurality of cylindrical double coned pressure sections said tubular woven sheath disposed over said cable member to form a pull cord;

wherein a total length of said pull cord is configured such that where said plurality of cylindrical double coned pressure sections are inserted into one end of a barrel, said pull cord extends past another end of said barrel; and wherein an outside diameter of said plurality of cylindrical double coned pressure sections is larger than a bore of said barrel and when compressed by insertion into said bore of said barrel each of said plurality of cylindrical double coned pressure sections provides a radial force pressing said tubular woven sheath of each cylindrical double coned pressure section of said plurality of cylindrical double coned pressure sections against an inside surface or a rifling of said barrel.

2. The gun cleaning device of claim 1, wherein each of said plurality of cylindrical double coned pressure sections comprises a thermoplastic.

3. The gun cleaning device of claim 1, wherein each of said plurality of cylindrical double coned pressure sections comprises a thermosetting rubber polymer or a thermoplastic elastomer.

4. The gun cleaning device of claim 1, wherein each of said plurality of cylindrical double coned pressure sections comprises a central substantially cylindrical shape disposed between on either end of said cylindrical shape a substantially cone shaped section.

5. The gun cleaning device of claim 1, wherein each of said plurality of cylindrical double coned pressure sections comprises a plurality of internal voids.

6. The gun cleaning device of claim 1, wherein said cable member comprises a coated cable.

7. The gun cleaning device of claim 6, wherein said coated cable comprises a coating selected from the group consisting of nylon, vinyl, and plastic.

8. The gun cleaning device of claim 1, wherein said cable member comprises a steel wire.

9. The gun cleaning device of claim 1, wherein said tubular woven sheath comprises a natural fiber.

10. The gun cleaning device of claim 1, wherein said tubular woven sheath comprises a synthetic fiber.

11. The gun cleaning device of claim 1, wherein said tubular woven sheath comprises a fiber selected from the group consisting of a heat resistant material, a meta-aramid, a Nomex, a para-aramid, a Kevlar, a fiberglass, and a K-fiber.

12. The gun cleaning device of claim 1, wherein said tubular woven sheath comprises a fiber selected from the group consisting of a nylon, a polystyrene, an acetal, an acrylic, a metallic thread, and a brass metallic thread.

13. The gun cleaning device of claim 1, wherein said tubular woven sheath comprises a phosphorescent thread or a luminescent thread.

14. The gun cleaning device of claim 1, further comprising a fitting disposed at one or both ends of said gun cleaning device.

15. The gun cleaning device of claim 14, further comprising a T-handle mechanically coupled to an end of said cable member by said fitting.

16. The gun cleaning device of claim 14, further comprising an accessory swab attachment mechanically coupled to an end of said cable member by said fitting.

17. The gun cleaning device of claim 14, further comprising an accessory brush attachment mechanically coupled to an end of said cable member by said fitting.

18. The gun cleaning device of claim 14, further comprising an accessory scraper attachment mechanically coupled to an end of said cable member by said fitting.

* * * * *